US005837431A

United States Patent [19]

Twist et al.

[11] Patent Number: 5,837,431

[45] Date of Patent: Nov. 17, 1998

[54] PHOTOGRAPHIC DEVELOPER/AMPLIFIER COMPOSITIONS

[75] Inventors: Peter Jeffrey Twist, Missenden; Christopher John Winscom, Pinner, both of United Kingdom

[73] Assignee: Eastman Kodak Company, Rochester, N.Y.

[21] Appl. No.: 985,534

[22] Filed: Dec. 5, 1997

Related U.S. Application Data

[62] Division of Ser. No. 911,403, Aug. 14, 1997, Pat. No. 5,738,980, which is a continuation of Ser. No. 556,553, Nov. 13, 1995, abandoned.

[30] Foreign Application Priority Data

Nov. 19, 1994 [GB] United Kingdom ..... 9423382

[51] Int. Cl.[6] ..... G03C 7/407

[52] U.S. Cl. ..... 430/373; 430/401; 430/490; 430/943

[58] Field of Search ..... 430/373, 401, 430/30, 943, 490, 567, 461; 396/626, 636

[56] References Cited

U.S. PATENT DOCUMENTS

| | | | |
|---|---|---|---|
| 4,126,461 | 11/1978 | Pupo et al. . | |
| 4,529,687 | 7/1985 | Hirai et al. | 430/373 |
| 5,411,842 | 5/1995 | Ridgway et al. . | |
| 5,738,980 | 4/1998 | Twist et al. | 430/414 |

*Primary Examiner*—Thorl Chea
*Attorney, Agent, or Firm*—J. Lanny Tucker

[57] ABSTRACT

Processing of color photographic materials can be accomplished using an aqueous redox amplifier composition comprising a color developing agent, an antioxidant therefor, hydrogen peroxide, and a stabilizing amount of nitrite ions to reduce dye loss during storage.

18 Claims, 1 Drawing Sheet

PHOTOGRAPHIC DEVELOPER/AMPLIFIER COMPOSITIONS

CROSS REFERENCE TO RELATED APPLICATION

This application is a Divisional of prior U.S. application No: 08/911,403 filed Aug. 14. 1997, U.S. Pat. No. 5,158,990 which is a FWC of U.S. No. 08/556,553 of Nov. 13. 1995. abandoned, claiming priority of GB 9423382.2 of Nov. 19, 1994.

FIELD OF THE INVENTION

This invention relates to photographic developer/amplifier solutions useful in redox amplification processes.

BACKGROUND OF THE INVENTION

Redox amplification processes have been described, for example in British Specification Nos. 1,268,126, 1,399,481, 1,403,418 and 1,560,572. In such processes color materials are developed to produce a silver image (which may contain only small amounts of silver) and then treated with a redox amplifying solution (or a combined developer/amplified) to form a dye image.

The developer/amplifier solution contains a color developing agent and an oxidizing agent that will oxidize the color developing agent in the presence of the silver image which acts as a catalyst.

Oxidized color developer reacts with a color coupler to form the image dye. The amount of dye formed depends on the time of treatment or the availability of color coupler and is less dependent on the amount of silver in the image as is the case in conventional color development processes.

Examples of suitable oxidizing agents include peroxy compounds including hydrogen peroxide, e.g., addition compounds of hydrogen peroxide; cobalt (III) complexes including cobalt hexammine complexes; and periodates. Mixtures of such compounds can also be used.

A serious problem with developer/amplifier solutions containing hydrogen peroxide or a precursor thereof is their stability because they contain both an oxidizing agent (the peroxide) and a reducing agent (the color developing agent) which react together spontaneously thus leading to loss of activity in a matter of an hour or two. The addition of an antioxidant for the color developer, e.g., a hydroxylamine compound is helpful but is, perhaps, not a complete solution.

Previously proposals have been made to overcome this problem. One proposal is to discard the contents of the processing tank when the process is idle and to refill it on restart. Another is to remove oxidant from the solution when the process is idle and to tope up to the correct concentration when it restarts. Both these solutions waste processing solution and can be complicated to implement.

SUMMARY OF THE INVENTION

According to the present invention there is provided an aqueous redox amplifier composition comprising a color developing agent, an antioxidant therefor, hydrogen peroxide or a compound that provides hydrogen peroxide, and a stabilizing amount of nitrite ions.

The developer/amplifier solution is stabilized against loss of dye yield on standing caused by loss of active components by spontaneous reaction or by aerial oxidation.

DETAILED DESCRIPTION OF THE INVENTION

Figure 1:
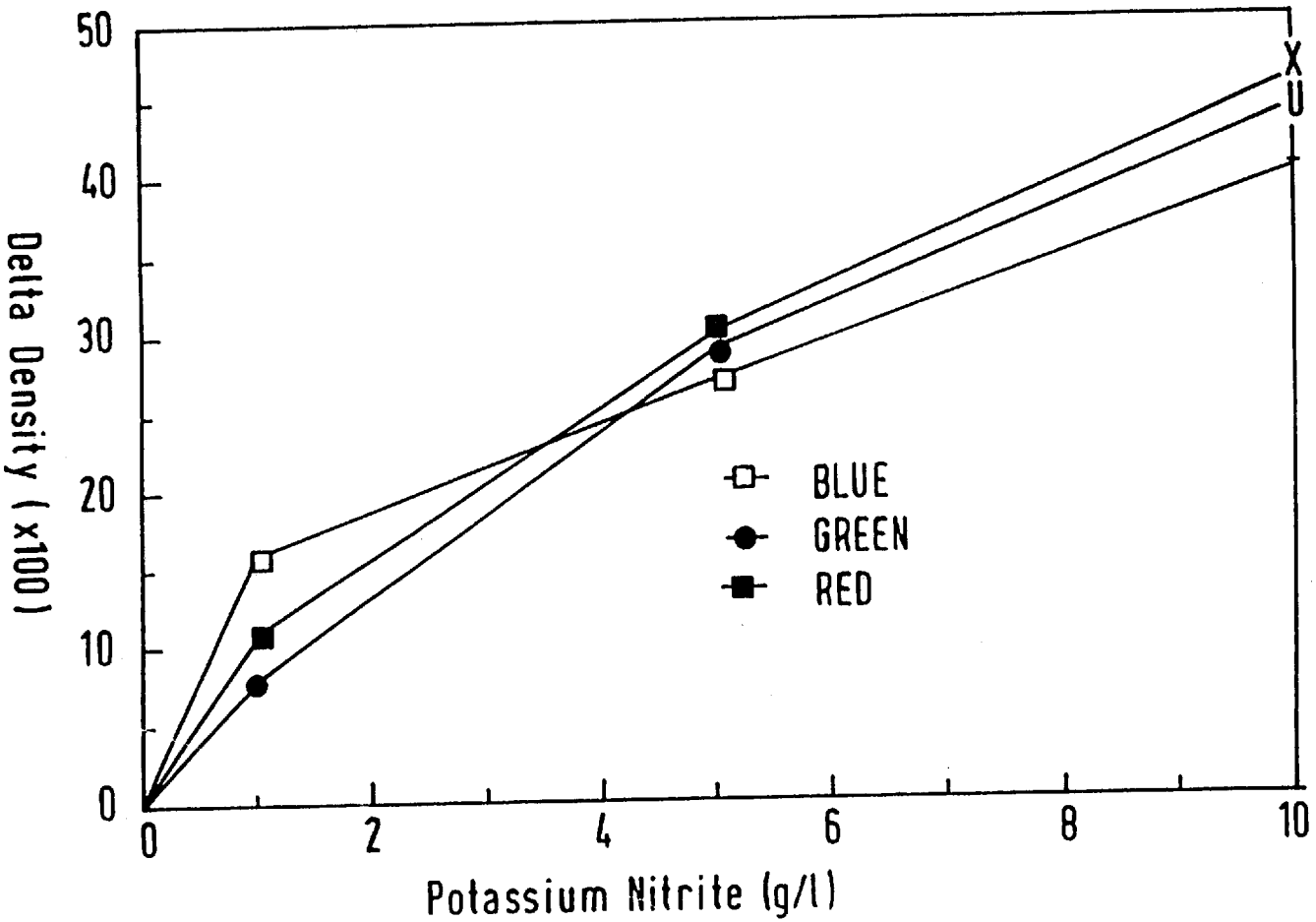
FIG. 1 of the accompanying drawings represents results from Examples 1 and 2.

Many compounds have been proposed for color developer antioxidants. Such compounds as hydrazines, hydroxylamines, hydroxyamic acids, oximes, nitroxy radicals, hydrazines, hydrazides, phenols, saccharides, monoamines, diamines, tertiary amines, polyamines, quaternary ammonium salts, alpha-hydroxy ketones, alcohols, diamides and disulphonamides. The preferred antioxidants are hydroxylamine compounds. Many antioxidants are described in European Patent No. 0 410 375.

Preferred antioxidants are hydroxylamine itself or any aryl- or alkyl-substituted derivative thereof, e.g., a dialkyl or diaryl-hydroxylamine, e.g., diethyl-hydroxylamine or salts thereof. These hydroxylamines can also be substituted, as described for example in, U.S. Pat. Nos.4,876,174 and 5,354,646, incorporated herein by reference. Useful substituted hydroxylamines include N-isopropyl-N-sulfonatoethyl hydroxylamine and bis(sulfonatoethyl)hydroxylamine.

The concentration range of nitrite ions is preferably from 0.2 to 50 g/l, particularly from 0.3 to 5 g/l and especially from 0.5 to 2.0 gl (as potassium nitrite). In general, the amount used is sufficient to stabilize the solution from loss of dye yield on standing.

The concentration range of the hydrogen peroxide is preferably from 0.1 to 10 ml/l, particularly from 0.3 to 7 ml/l and especially from 0.5 to 5 ml/l (as 30% w/w solution).

The concentration range of the antioxidant may be from 0.1 to 6 g/l (as hydroxylamine sulphate), preferably from 0.3 to 4 g/l, particularly from 0.5 to 2 g/l.

The pH is preferably buffered by a phosphate but other buffers can be used. The pH is preferably in the range 10.5 to 12, particularly from 11 to 11.7 and especially from 11 to 11.4.

The nitrite ions are preferably added as an alkali metal nitrite, e.g., potassium or sodium nitrite.

Typically the developer/amplifier contains color developing agent at concentrations of 0.5 to 15 g/l, preferably from 2 to 5 g/l.

The color photographic material to be processed may be of any type but will preferably contain low amounts of silver halide. Preferred total silver halide coverages are in the range 6 to 300, preferably 10 to 200 $mg/m^2$ and particularly 10 to 100 $mg/m^2$ (as silver). The material may comprise the emulsions, sensitizers, couplers, supports, layers, additives, etc., described in Research Disclosure, December 1978, Item 17643, published by Kenneth Mason Publications Ltd. Dudley Annex, 12a North Street, Emsworth, Hants P010 7DQ, U.K.

In a preferred embodiment the photographic material to be processed comprises a resin-coated paper support and the emulsion layers comprise more than 80%, preferably more than 90% silver chloride and are more preferably composed of substantially pure silver chloride.

The photographic materials can be single color materials or multicolor materials. Multicolor materials contain dye image-forming units sensitive to each of the three primary regions of the spectrum. Each unit can be comprised of a single emulsion layer or of multiple emulsion layers sensitive to a given region of the spectrum. The layers of the materials, including the layers of the image-forming units, can be arranged in various orders as known in the art.

A typical multicolor photographic material comprises a support bearing a yellow dye image-forming unit comprised of a least one blue-sensitive silver halide emulsion layer having associated therewith at least one yellow dye-forming coupler, and magenta and cyan dye image-forming units comprising at least one green- or red-sensitive silver halide emulsion layer having associated therewith at least one magenta or cyan dye-forming coupler respectively. The material can contain additional layers, such as filter layers.

The processing may be carried out by hand or in a processing machine of which many types are known. Preferably the processing is carried out by passing the material to be processed through a tank containing the processing solution which is recirculated through the tank at a rate of from 0.1 to 10 tank volumes per minute.

The preferred recirculation rate is from 0.5 to 8, especially from 1 to 5 and particularly from 2 to 4 tank volumes per minute.

The recirculation, with or without replenishment, is carried out continuously or intermittently. In one method of working both could be carried out continuously while processing was in progress but not at all or intermittently when the machine was idle. Replenishment may be carried out by introducing the required amount of replenisher into the recirculation stream either inside or outside the processing tank.

It is advantageous to use a tank of relatively small volume. Hence in a preferred embodiment of the present invention the ratio of tank volume to maximum area of material accommodatable therein (i.e., maximum path length x width of material) is less than 11 $dm^3/m^2$, preferably less than 3 $dm^3/m^2$.

The shape and dimensions of the processing tank are preferably such that it holds the minimum amount of processing solution while still obtaining the required results. The tank is preferably one with fixed sides, the material being advanced therethrough by drive rollers. Preferably the photographic material passes through a thickness of solution less than 11 mm, preferably less than 5 mm and especially about 2 mm. The shape of the tank is not critical but it could be in the shape of a shallow tray or, preferably U-shaped. It is preferred that the dimensions of the tank be chosen so that the width of the tank is the same or only just wider than the width of the material to be processed.

The total volume of the processing solution within the processing channel and recirculation system is relatively smaller as compared to prior art processors. In particular, the total amount of processing solution in the entire processing system for a particular module is such that the total volume in the processing channel is at least 40 percent of the total volume of processing solution in the system. Preferably, the volume of the processing channel is at least about 50 percent of the total volume of the processing solution in the system.

In order to provide efficient flow of the processing solution through the opening or nozzles into the processing channel, it is desirable that the nozzles/opening that deliver the processing solution to the processing channel have a configuration in accordance with the following relationship:

$$0.6 \leqq F/A \leqq 23$$

wherein:

F is the flow rate of the solution through the nozzle in liters/minute; and

A is the cross-sectional area of the nozzle provided in square centimeters.

Providing a nozzle in accordance with the foregoing relationship assures appropriate discharge of the processing solution against the photosensitive material.

The following Examples are included for a better understanding of the invention.

EXAMPLE 1

Comparative Example

A developer/amplifier solution (Dl) of the composition shown in Table 1 below was prepared and left to stand in glass cylinders in a water thermostat bath 32° C. At the start which was immediately after the hydrogen peroxide was added and at various time intervals thereafter sensitometric paper strips were processed in the developer/amplifier bath.

TABLE 1

| Developer/amplifier D1 | |
|---|---|
| Sequestrant 1 | 0.6 g/l |
| Sequestrant 2 | 2.0 ml/l |
| $K_2HPO_4 . 3H_2O$ | 40.0 g/l |
| KBr | 1.0 mg/l |
| KCl | 0.5 g/l |
| Catechol disulphonate (DCS) | 0.3 g/l |
| Hydroxylamine sulphate (HAS) | 1.0 g/l |
| KOH (50%) | 10.0 ml/l |
| CD3 | 4.5 g/l |
| pH | 11.4 |
| $H_2O_2$ (30%) | 2.0 ml/l |
| Time | 45 seconds |
| Temperature | 32° C. |

Where Sequestrant 1 is 60% solution of 1-hydroxy hydroxy ethylidene-1,1-diphosphonic acid, Sequestrant 2 is a 41% solution of the penta sodium salt of diethylene triamine penta acetic acid and the color developing agent CD3 is N-[2-(4-amino-N-ethyl-m-toluidino)ethyl]-methanesulphonamide sesquisulphate hydrate.

EXAMPLE 2

(Invention)

Three developer/amplifiers were prepared similar to that in Table 1 except that potassium nitrite was included at 1, 5 and 10 g/l (developer/amplifiers D2–D4). The standing stability observed was assessed by means of sensitometric strips. The process cycle was as follows:

Developer 45 seconds

Fixer 30 seconds

Wash 2 minutes

Dry

The fixer consisted of glacial acetic acid (20 ml/l), sodium sulphite (50 g/l), sodium thiosulphate (20 g/l) and sodium hydroxide (20 g/l).

A sensitive parameter in paper sensitometry is the maximum density of a neutral exposure of Dmax(N). In Table 2 the change in Dmax(N) with time is shown for the four developers above.

These solutions are monitored with time while standing at operating temperature in glass measuring cylinders using standard paper control strips then the Dmax falls as shown in Table 2.

TABLE 2

Effect Of Nitrite On Neutral Dmax (×100)

| Time | D1 | | | D2 | | | D3 | | | D4 | | |
|---|---|---|---|---|---|---|---|---|---|---|---|---|
| (Hrs) | R1 | G1 | B1 | R2 | G2 | B2 | R3 | G3 | B3 | R4 | G4 | B4 |
| 0 | 266 | 265 | 263 | 249 | 264 | 270 | 249 | 246 | 243 | 250 | 266 | 271 |
| 24 | 264 | 263 | 255 | 263 | 274 | 269 | 252 | 273 | 264 | 263 | 276 | 272 |
| 48 | 267 | 264 | 249 | 262 | 269 | 269 | 265 | 269 | 266 | 262 | 268 | 268 |
| 72 | 276 | 268 | 254 | 268 | 267 | 263 | 268 | 269 | 255 | 263 | 268 | 258 |
| 96 | 278 | 272 | 227 | 276 | 272 | 255 | 274 | 278 | 258 | 270 | 267 | 256 |
| 192 | 223 | 232 | 232 | 231 | 241 | 237 | 250 | 256 | 236 | 256 | 269 | 238 |
| 216 | 121 | 138 | 138 | 132 | 146 | 165 | 151 | 167 | 176 | 167 | 182 | 189 |

In the table R1, G1 and B1, etc., refer to the red, green and blue densities for each of the developer/amplifiers described above. It can be seen that the Dmax densities are better maintained at longer standing times in the presence of potassium nitrite.

The density difference between the control and test developer/amplifiers in the red, green and blue records at 216 hours standing time is plotted as a function of potassium nitrite level the curve in FIG. 1 is obtained. It can be seen that there is a progressive improvement over the control developer with increase in potassium nitrite level.

EXAMPLE 3

(Invention)

In this example the effect of nitrite ion on the stability of an RX developer/amplifier in a forced aeration test was examined. A control developer/amplifier without nitrite ion of the formula shown in Table 3 was used.

TABLE 3

Developer/Amplifier (D5)

| | |
|---|---|
| Sequestrant 1 | 0.6 g/l |
| Sequestrant 2 | 2.0 ml/l |
| $K_2HPO_3 . H_2O$ | 40 g/l |
| KBr | 1 mg/l |
| KCl | 0.5 g/l |
| Catechol disulphonate (CDS) | 0.3 g/l |
| Hydroxylamine sulphate (HAS) | 1.0 g/l |
| KOH (50%) | 10.0 ml/l |
| CD3 | 4.5 g/l |
| Tween 80 | 0.4 g/l |
| Dodecylamine | 0.1 g/l |
| pH | 11.4 |
| $H_2O_2$ (30%) | 2.0 ml/l |
| Time | 45 seconds |
| Temperature | 32° C. |

Where TWEEN 80 is a non-ionic polyoxyethylene surfactant and is a Trade Mark of Atlas Chemical Industries Inc.

Another developer/amplifier (D6) was made by adding 20 g/l of potassium nitrite to developer/amplifier D5. These two developer/amplifiers were then compared in an aeration test in which compressed air was bubbled through each solution for several hours. At intervals the bubbling was stopped and a sensitometric strip was processed in each developer/amplifier and the maximum density (Dmax) was monitored during the experiment. The change in Dmax with time is shown in Table 4.

TABLE 4

Effect of nitrite on aeration

| Time | Neutral Dmax (× 100) | | | | | |
|---|---|---|---|---|---|---|
| Bubbling | D5 | | | D6 | | |
| (hours) | R | G | B | R | G | B |
| 0 | 248 | 240 | 232 | 263 | 244 | 223 |
| 1 | 264 | 251 | 235 | 263 | 251 | 231 |
| 2 | 264 | 250 | 230 | 271 | 258 | 234 |
| | | Overnight (no bubbling) | | | | |
| 3 | 277 | 264 | 234 | 265 | 252 | 233 |
| 4 | 266 | 255 | 221 | 267 | 247 | 210 |
| 5 | 264 | 251 | 219 | 276 | 260 | 236 |
| 6 | 248 | 237 | 202 | 266 | 252 | 217 |
| 7 | 223 | 214 | 193 | 257 | 246 | 205 |
| 8 | 197 | 195 | 189 | 259 | 246 | 217 |

The loss of density (×100) over 8 hours aeration in D5 is 51 in red, 45 in green and 43 in blue. The corresponding loss in D6 is 4 in red, −2 in green and 6 in blue. This clearly shows that the presence of nitrite ion reduces density loss on aeration of the developer/amplifier.

The invention has been described in detail with particular reference to preferred embodiments thereof, but it will be understood that variations and modifications can be effected within the spirit and scope of the invention.

We claim:

1. A method for processing imagewise exposed color photographic element comprising contacting said element with an aqueous redox amplifier composition comprising a color developing agent, an antioxidant for said composition which is hydroxylamine or a derivative thereof, hydrogen peroxide or a compound which provides hydrogen peroxide in an amount of from 0.1 to 10 ml/l (as a 30% weight % hydrogen peroxide solution), and nitrite ions as a dye yield stabilizer for said composition.

2. The method of claim 1 wherein said color photographic element has a total silver halide coverage of from 6 to 300 $mg/m^2$.

3. The method of claim 1 wherein said color photographic element comprises 80% or more silver chloride in the emulsion layers.

4. The method of claim 1 wherein said color photographic element comprises 90% or more silver chloride in the emulsion layers.

5. The method of claim 1 wherein said aqueous solution is sued at a recirculation rate of from 0.1 to 10 tank volumes per minute.

6. The method of claim 1 carried out in a processing tank wherein the ratio of tank volume to maximum area of element processed is less than 11 $dm^3/m^2$.

7. The method of claim 1 carried out in a processor having a processing channel which comprises at least about 40% of the total volume of said aqueous solution in said processor.

8. The method of claim 7 wherein said processor comprises at least one nozzle for solution delivery having a configuration of:

$$0.6 \leqq F/A \leqq 23$$

wherein F is the flow rate of said solution through said nozzle in 1/min, and A is the cross-sectional area of said nozzle in cm.

9. The method of claim 1 wherein said color photographic element is a color photographic paper comprising a resin-coated paper support and substantially silver chloride emulsions.

10. The method of claim 1 wherein the concentration of nitrite ions in said composition is from 0.2 to 50 g/l.

11. The method of claim 10 wherein the concentration of nitrite ions in said composition is from 5 to 20 g/l.

12. The method of claim 1 wherein the antioxidant is an aryl or alkyl-substituted hydroxylamine derivative.

13. The method of claim 1 wherein said antioxidant is present in a concentration of from 0.5 to 4 g/l.

14. The method of claim 1 wherein the ratio of hydrogen peroxide to hydroxylamine compound is from 1.5 to 2.5.

15. The method of claim 1 wherein said composition has a pH of from 11 to 11.7.

16. The method of claim 1 wherein said composition is buffered by a phosphate.

17. The method of claim 1 wherein the concentration of hydrogen peroxide in said composition is from 0.5 to 7 ml/l when provided as a 30 weight % hydrogen peroxide solution.

18. The method of claim 10 wherein said antioxidant is present in said composition at a concentration of from 0.1 to 6 g/l.

* * * * *